United States Patent [19]

Schroendorfer

[11] 4,445,883

[45] May 1, 1984

[54] DEFORMABLE SUPPORT FOR FLUID PROCESSING CENTRIFUGE

[75] Inventor: Donald W. Schroendorfer, Brookline, Mass.

[73] Assignee: Haemonetics Corporation, Braintree, Mass.

[21] Appl. No.: 339,910

[22] Filed: Jan. 18, 1982

[51] Int. Cl.[3] ..... B04B 7/04; B04B 7/12

[52] U.S. Cl. ..... 494/21; 494/27; 494/45

[58] Field of Search ..... 194/16, 17, 18, 19, 194/21, 27, 45

[56] References Cited

U.S. PATENT DOCUMENTS

| | | | |
|---|---|---|---|
| 3,987,961 | 10/1976 | Sinn et al. | 494/45 |
| 4,146,172 | 3/1979 | Cullis et al. | 233/26 |
| 4,285,464 | 8/1981 | Latham, Jr. | 233/26 |
| 4,304,357 | 12/1981 | Schoendorfer | 494/27 |

*Primary Examiner*—Harvey C. Hornsby
*Assistant Examiner*—Michael Knick
*Attorney, Agent, or Firm*—Hamilton, Brook, Smith & Reynolds

[57] ABSTRACT

A deformable support for a pressure plate blood processing centrifuge apparatus is described. A plate 50 is disposed adjacent a deformable support 10 having a recess for a flexible bag 8 in which blood is processed. Under the influence of centrifugal force the plate 50, which is disposed inwardly nearer the center of rotation than the bag 8, exerts a force against the support 10 and bag 8 and expels a separated blood component from the bag into a receiver container 6.

The support 10 absorbs forces in the bag 8 thereby enabling the bag to be made of thin walled inexpensive material which would otherwise rupture under the separation forces. Yet the support 10 is sufficiently yielding to enable the pressure plate 50 to move and create an expelling force.

7 Claims, 10 Drawing Figures

DEFORMABLE SUPPORT FOR FLUID PROCESSING CENTRIFUGE

DESCRIPTION

TECHNICAL FIELD

This invention is in the field of fluid processing and more particularly relates to the centrifugal separation of fluid, such as blood, into two or more components.

BACKGROUND ART

A copending U.S. patent application Ser. No. 281,655 filed July 9, 1981 describes a new and improved pheresis process and apparatus generally constructed as follows. A first container, in the form of a flexible bag containing anticoagulated whole blood to be centrifugally separated, is located on a centrifuge rotor a suitable distance away from the center of rotation of the rotor. A second container is disposed adjacent the first container and in fluid communication with the first container. The second container, which also may be a flexible bag, is adapted to receive one or more of the centrifugally separated components of the anticoagulated whole blood.

A pressure plate in the form of a body of material, such as a metal plate, having a predetermined mass is disposed between the first bag and the center of rotation of the rotor. This pressure plate is suspended so that it is free to move radially against the first bag when subjected to the centrifugal forces generated by rotation of the centrifuge. The pressure plate has a predetermined mass sufficient to at least initiate a flow of separated fluid component from the first bag to the second bag as the pressure plate presses against the first bag during rotation of the centrifuge rotor.

The pressure plate has a predetermined mass distribution and shape adapted to pool the separated first blood component in the area of the output of the fluid communication to the second bag. The pressure plate is adapted to press against the first bag and cause the radius at the output of the first bag to be located at the minimum radius of the first bag in the centrifuge.

The first bag and second bag are located adjacent each other on the rotor with the first bag positioned radially inward from the second bag. A siphon effect is created when flow is initiated from the first bag to the second bag as the pressure plate pushes against the first bag under the influence of centrifugal force. The siphon effect is due to the difference in centrifugal forces to which the bags are subjected because one bag is located nearer the center of rotation than the other.

Flow from the first bag to the second bag, once initiated, continues regardless of the specific gravity of the separated blood component. Therefore, a valve is provided in accordance with copending U.S. patent application, Ser. No. 281,649 filed July 9, 1981. This valve may be in the form of a stopper, such as a ball, having a specific gravity less than the component or components to be retained in the first bag, but greater than the component or components to be expressed into the second bag.

Prior to the start of the pheresis procedure, a sufficient volume of anticoagulant may be stored in the first bag. Alternatively, the anticoagulant may be mixed with the whole blood as it is drawn from the donor and passes into the first bag.

After the whole blood is collected in the first bag; the first and second bags with appropriate interconnections (and optionally additional bags if further separation is required) are loaded into a cassette, such as a free standing rack partitioned into a number of vertically extending annular sections (one for each bag) having a shape corresponding to a segment of a cylinder with a radius corresponding to the radius to the center of rotation of the centrifuge rotor.

The centrifuge is then brought to a suitable speed, for example 2000 r.p.m., for a sufficient time to achieve centrifugal separation of blood components within the first bag. During this separation time or "dwell period", the conduit between the first and second bag is closed off by suitable means, such as the timing mechanism described in copending U.S. patent application, Ser. No. 281,650 filed July 9, 1981.

After a sufficient dwell period has elapsed, the conduit between bags is opened by the timing mechanism to allow flow of separated component, such as plasma, from the first bag to enter the second bag.

During the dwell period, the pressure to which the bags are subjected is considerable and may be calculated as follows:

$$P=\tfrac{1}{2}\rho\omega^2\,[r_o^2-r_i^2]$$

where:

$P$=pressure in dynes per $cm^2$.

$\rho$=density of blood in grams per $cm^3$.

$\omega$=rotating velocity in radians per second.

$r_o$=outside radius of the bag in cm.

$r_i$=inside radius of the bag in cm.

The pressure in dynes per $cm^2$ is converted to pounds per square inch (psi) by multiplying by $1.45\times10^{-5}$. In a typical embodiment of the pheresis apparatus described in the above referenced patent application Ser. No. 281,655, the pressure on the first bag is about 59 psi based on a 2000 r.p.m. dwell period rotor speed, a $\rho$ of 1.1 $gm/cm^3$, and wherein $r_i=0$ and $r_o=13$ cm.

Commonly, the first bag is manufactured from two sheets of PVC welded together at the edges. The welds and material of an unsupported thin-wall common PVC blood bag will not withstand 59 psi for even a short period of time. Yet it is desirable to employ inexpensive construction and materials in the fabrication of the bags constituting the pheresis software set; since they are disposable items and cannot be used more than once.

Rather than go to expensive materials and construction for the bags, one might consider a support structure for the bags as described in U.S. Pat. No. 4,146,172 dated Mar. 27, 1979 to Cullis et al. In the 172' patent, a separation chamber is constructed of two sheets of PVC or other hemo-compatible plastic material bonded together to form a shaped inner compartment.

The separation chamber is carried in a pair of rectangular plates formed of thermal conductivity metal (column 8, lines 7–10). The plates have recesses forming compartments for receiving the chamber. Pressure on the chamber seams is relieved by an interior rib provided on the periphery of one recess (column 8, lines 20–26).

The rigid plates in the 172' patent are similar to the shoes in U.S. Pat. No. 4,285,464 issued to Latham, Jr. They provide a rigid recess which supports the separation bag so it can withstand high operating pressures.

Unfortunately, such a solution is not available in a pheresis system, such as above described, which relies on the movement of a weight or pressure plate against one side of a flexible bag to express separated component from a processing chamber (the flexible bag) which has a variable volume.

DISCLOSURE OF THE INVENTION

In the apparatus of the present invention, a deformable support is provided. The support has a recess shaped to accept and support a flexible blood processing bag. The support may be a thick walled chamber formed in a cast. The support material may be any of the many polymeric materials, such as neoprene, latex or silicone, which, while being flexible, do have sufficient resilience to provide a degree of force absorption capability.

The support may completely encircle the blood processing bag and have a slit for inserting the bag, or it may be substantially open on one side. The support may be mounted on the pressure plate or on the vertically extending segments of the centrifuge cassette. The flexible bag is inserted into the recess in the support.

In operation, the centrifugal force is applied by the pressure plate against the support; since the bag is in intimate contact with the support, corresponding reactive force is generated in the bag. However, unlike the prior art unsupported bag structure; the outward acting force generated in the bag is substantially absorbed by the deformable support. Thus, the full strength of this force is not absorbed by the bag wall or the edge weld. In addition, the shape of the support can be so designed to minimize the tearing and shearing forces on the relatively weak weld of the bag.

Since the support is deformable, sufficient movement is permitted to enable the pressure plate to generate the requisite force to initiate flow of separated blood component from the first bag to the second bag.

These and other advantages will become apparent from the following description of the best mode for carrying out the invention.

Figure 5:
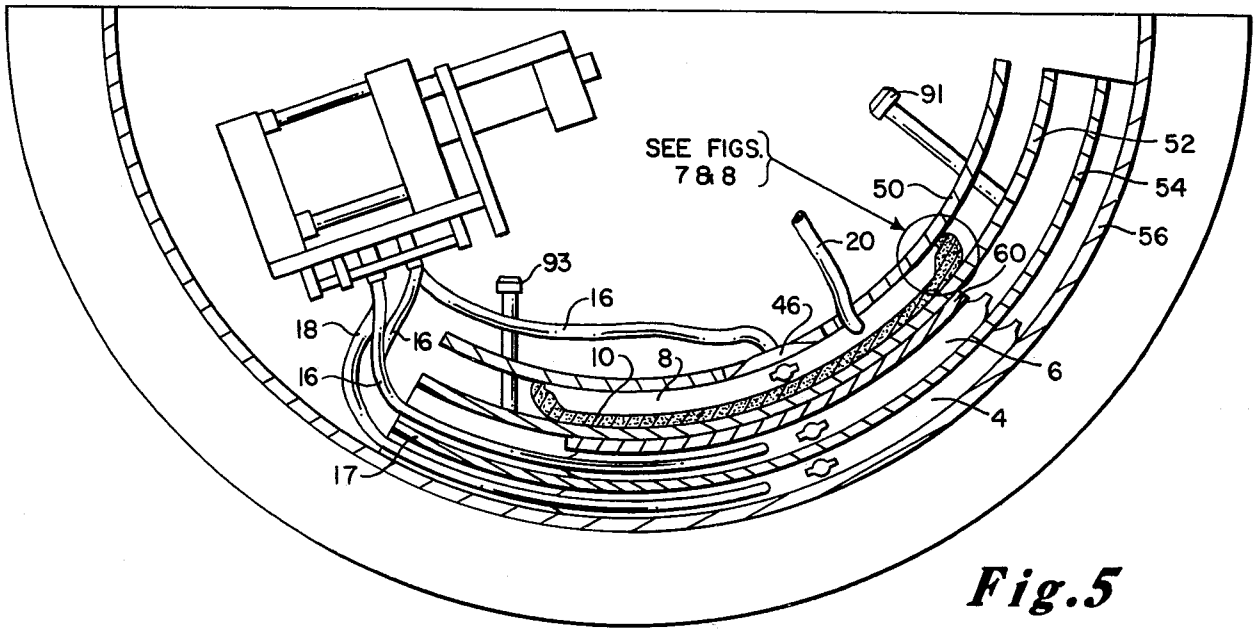
FIG. 5 is a diagramatic sectional illustration of the details of the cassette and software set of FIG. 1 interconnected with a hydraulic timer mechanism.

FIGS. *7a* and *7b* are enlarged sectional views of the area circled in FIG. 5 showing the forces acting in the bag 8 prior to application of centrifugal force (*7a*) and after application of centrifugal force (*7b*).

Figure 6:
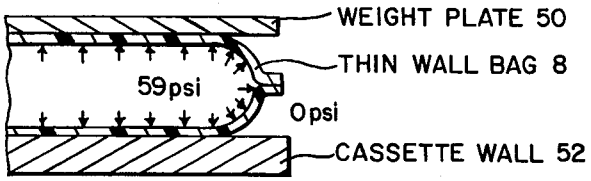
FIG. 6 is an enlarged partial sectional view of an unsupported bag structure as described in co-pending patent application, Ser. No. 281,649.
Figure 7A:
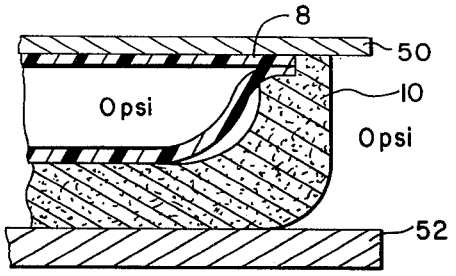
Figure 7B:
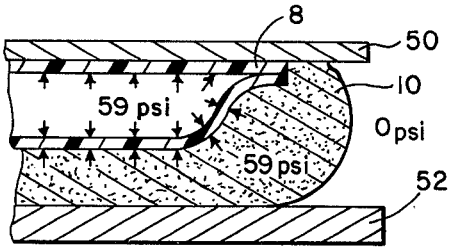
Figure 8A:
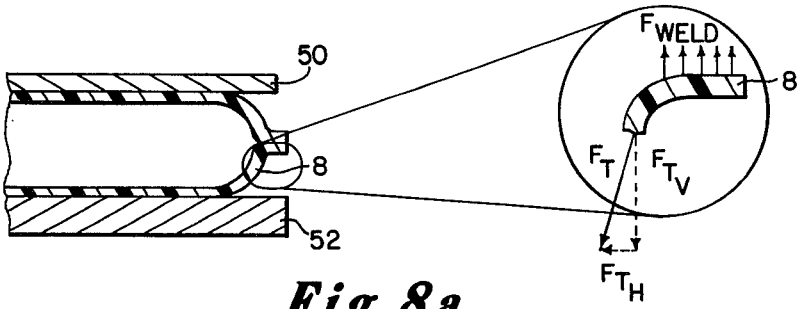
Figure 8B:
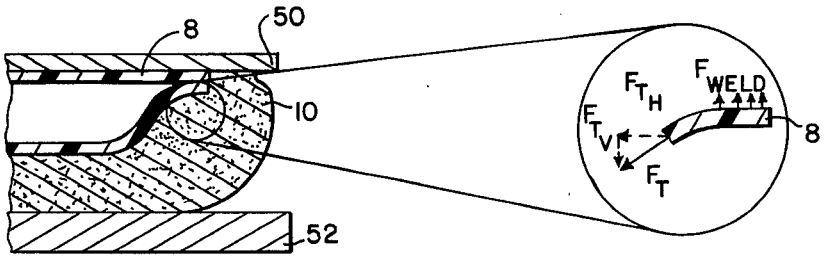

FIGS. *8a* and *8b* are enlarged views of the cross-sections of FIGS. 6 and 7, respectively, showing the forces exerted at the weld areas of bag 8 in an unsupported bag FIG. *8a* versus a supported bag FIG. *8b*.

BEST MODE FOR CARRYING OUT THE INVENTION

As used herein, the following terms are defined to mean:

"First blood component"—one fraction of blood which it is desired to separate from another fraction;

"Second blood component"—another fraction separated from blood which is the balance after first blood component has been separated therefrom;

"Platelet-rich plasma" or "PRP"—a fraction of plasma which is rich in platelets;

"Platelet-poor plasma" or "PPP"—a fraction of plasma which is poor in platelets;

"Packed red blood cells" or "RBC"—a fraction of blood which is rich in red blood cells.

In general, it may be seen that this invention comprises an apparatus and process for separating blood into components thereof in a centrifuge. The invention is particularly suitable for various pheresis processes, such as, (a) plasma-pheresis, wherein whole blood is removed from a donor, separated into cell-free plasma and packed red blood cells followed by reinfusion of the autologous red cells or (b) platelet-pheresis, wherein whole blood is removed from a donor and separated into three components, platelet-rich plasma (PRP), platelet-poor plasma (PPP) and packed red blood cells (RBC) followed by reuniting the PPP and RBC which are returned to the donor, or similar component separation where the donor donates a unit of blood which is separated into plasma and packed red cells; plasma, platelets and packed red cells; or plasma, platelets, white cells and packed red cells.

For purposes of explanation, the invention will generally be described in connection with component separation of whole blood into plasma, platelets, and packed red cells by centrifugal separation in accordance with the specific gravity of the components but the invention is not intended to be limited thereby. For example, separation in accordance with the sedimentation rate of individual components is also contemplated by this invention Furthermore, the invention will be described in connection with specific centrifuge apparagus found in certain copending applications. However, the invention is not intended to be limited thereby, since other applications of the basic concept may be equally important.

It is also contemplated that a Self-Balancing Centrifuge as described in U.S. patent application Ser. No. 281,648, or equivalent, will supply the necessary centrifugal force for blood processing in accordance with the invention and a Pheresis Valve, as described in U.S. patent application Ser. No. 281,649, or equivalent, will provide the means for automatically terminating flow once a precise cut is achieved between components.

Figure 1:
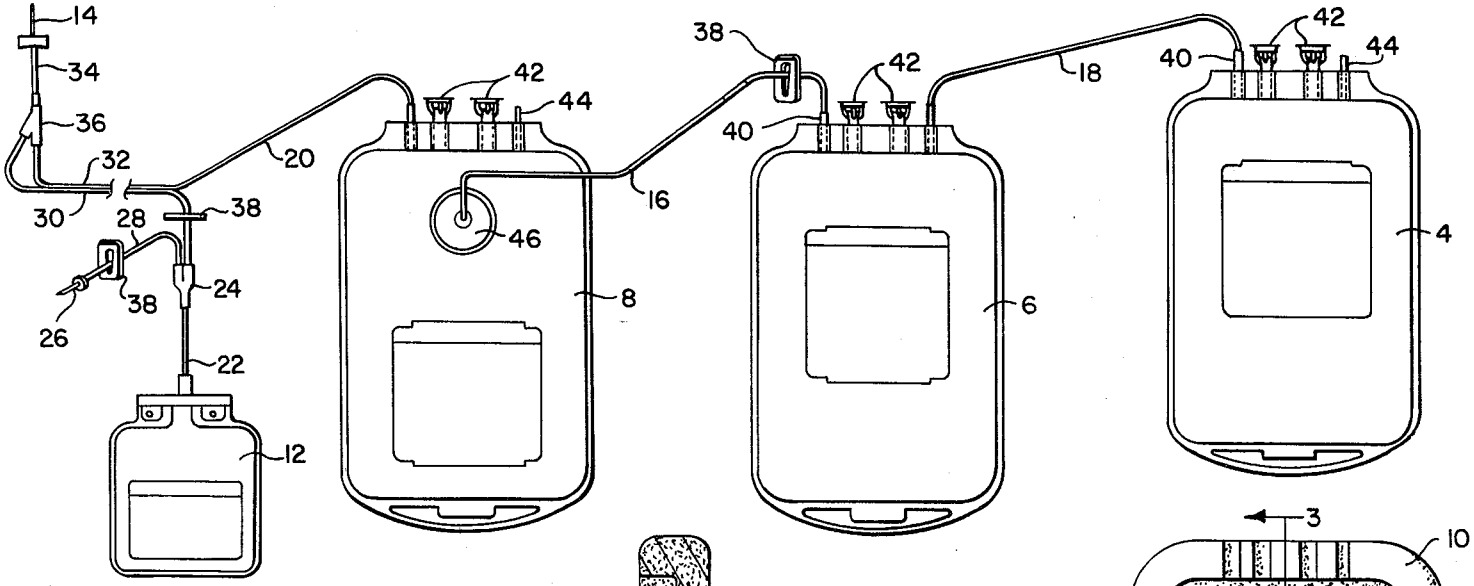
FIG. 1 is a plan view of a disposable software set utilized in an embodiment of the invention.

Referring now to FIG. 1, there is shown a software set suitable for use in connection with the present invention. The software set consists essentially of four interconnected flexible bags 4, 6, 8 and 12. These bags may be made of suitable thin walled hemo-compatible plastic material, such as polyvinyl chloride (PVC). The basic construction of these bags consists of forming two sheets of material in accordance with the desired bag shape and welding the edges of the sheets together to form an interior chamber for the bag.

In the apparatus of the invention, bag 8 is adapted to be the bag located closest to the center of rotation of the rotor and would therefore be utilized as a blood separation bag in which anticoagulated whole blood will be received for separation into plasma and red blood cells under the influence of centrifugal force. The anticoagulant may be stored in the blood bag 8 prior to infusion of whole blood or as shown in FIG. 1, a separate anticoagulant bag 12 may be supplied with anticoagulant which may be mixed with the whole blood drawn from a donor via phlebotomy needle 14, as described in copending patent applications Ser. Nos. 182,510 and 256,694.

In other words, as blood is drawn from the donor through phlebotomy needle 14, anticoagulant stored in anticoagulant bag 12 may be ratioed through tubing 22, Y-connector 24, tubing 30 to Y-connector 36, where it is mixed with whole blood from tubing 34 and the anticoagulated whole blood is passed through tubing 20 to a connector on bag 8 and into the interior of bag 8.

Suitable slide clamps 38 for closing off the various tubing connections are provided with the software set but need not be described in detail herein. Also provided with the blood processing bags, 4, 6 and 8 are bag spikes 42 to provide access to the interior of the bags for various purposes unrelated to the present invention.

Blood processing bag 8 is provided with a pheresis valve inside an umbilical fitment 46, as shown in greater detail in U.S. patent application, Ser. No. 281,649. The output port of the pheresis valve is coupled via tubing 16 to the input port of bag 6, in which is collected plasma for separation into platelet-rich plasma (PRP) and platelet-poor plasma (PPP). The platelet-poor plasma is passed through tubing 18 into PPP bag 4 after being separated in PRP bag 6. All of this is accomplished in accordance with the teaching of the aforementioned copending U.S. patent application, Ser. No. 281,655 and accordingly need not be described in detail herein.

In any event, after bag 8 has been filled with anticoagulated whole blood, tubing 20 is heat-sealed to close bag 8 and the section of tubing 20 containing the phlebotomy needle and anticoagulant bag 12 is discarded. The software set of FIG. 1 is then mounted in the cassette of FIG. 4, which is located on the centrifuge of FIG. 5.

Figure 4:
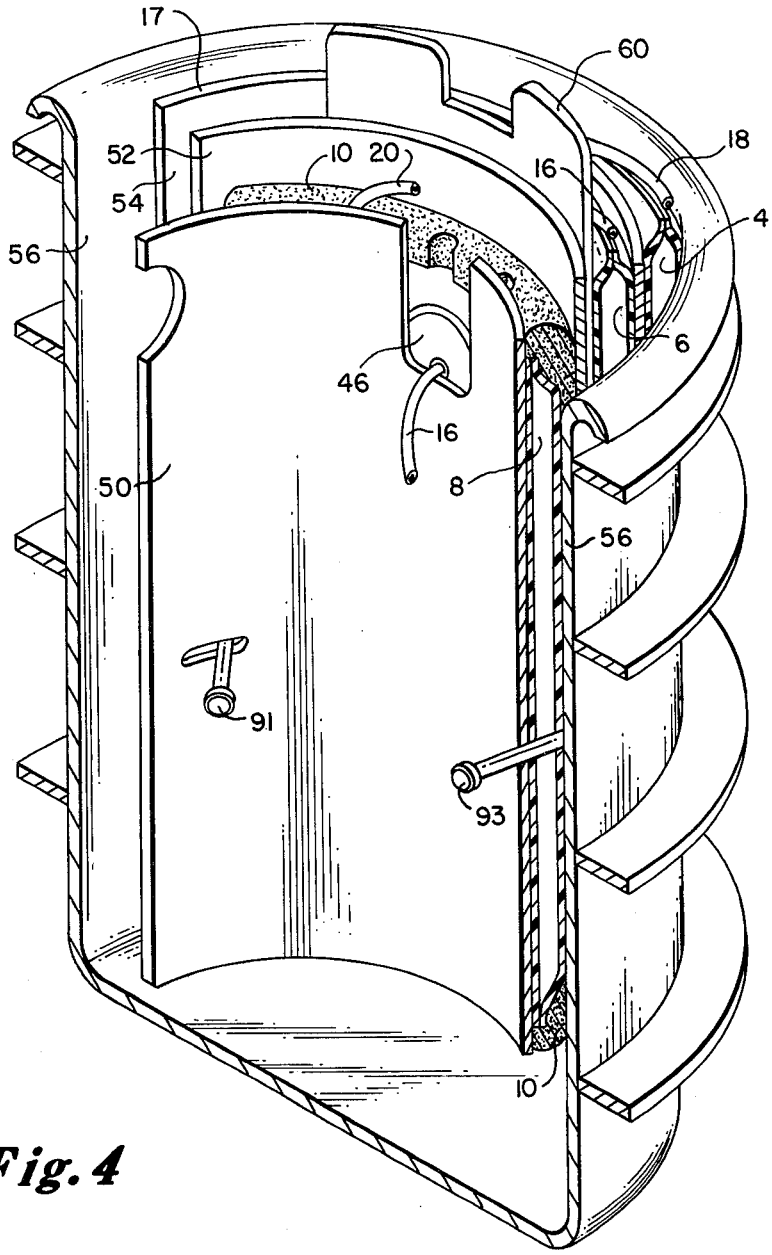
FIG. 4 is an enlarged perspective view of a cassette as mounted in a centrifuge, without the disposable software set, but including the support 10.

Referring now to FIGS. 4 and 5, the cassette 17 consists of a stand or rack which is partitioned into three annular sections by two vertically positioned support members 52 and 54, each having a shape generally described by a segment of a cylinder with a radius corresponding to the radius to the center of rotation of the centrifuge rotor.

A pressure plate 50 is mounted adjacent to the innermost vertical section of the cassette and is suspended on two mounting bolts 91 and 93. The pressure plate is mounted in such a manner that it is free to move or float against blood processing bag 8 under the influence of centrifugal force when the rotor is spinning and the whole blood bag is mounted, as shown in FIG. 5, between the pressure plate 50 and the vertical cassette member 52.

Figure 2:
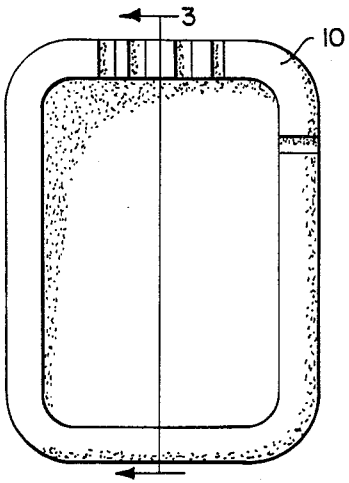
FIG. 2 is a plan view of a deformable support 10.
Figure 3:
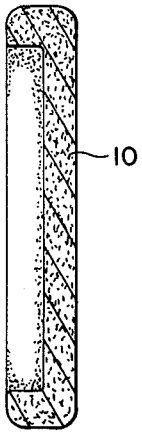
FIG. 3 is a cross-sectional view along the lines 3—3 of FIG. 2.

In accordance with the invention, a deformable support 10, shown in detail in FIGS. 2 and 3, is provided on wall 52. The support has a recess shape to accept and support flexible blood processing bag 8. The support consists of a thick-walled recess formed in a cast. The support material may be any of many polymeric materials, such as neoprene, latex or silicone, which are flexible but have sufficient strength to absorb the centrifugal forces exerted in the centrifuge. The support may be in the form of a chamber which completely encircles blood processing bag 8 or it may be a recess substantially open on one side, as shown in FIGS. 2 and 3. The support may be mounted on the vertical extending segment of the centrifuge cassette, as shown in FIGS. 4 and 5, or it may be mounted on the pressure plate 50.

Bag 8 is disposed in the support 10 while pressure plate 50 is moved radially inward. This allows sealed bag 8 filled with anticoagulated whole blood to be inserted into the recess in support 10 between the plate 50 and the support 10. The PRP bag 6 is inserted into the next section of the cassette and PPP bag 4 in the last section, which is the section furthest removed from the center of rotation.

An additional pressure plate 60 may be provided adjacent the side of the PRP bag 6 nearest the center of rotation. As is described in detail in copending U.S. patent application Ser. No. 281,649, this pressure plate cooperates with a flexible elastomeric gasket to isolate platelets and prevent them from flowing out the PPP tube 18.

The respective tubing 16 and 18 interconnecting the PRP bag 6 with the whole blood bag 8 and PPP bag 4 with the PRP bag 6 are inserted in respective clamps of the hydraulic timer mechanism 15.

In operation, tubing 16 and tubing 18 are initially clamped "off" by operation of the hydraulic timer mechanism 15. The centrifuge is then brought to a suitable speed, for example, 2000 r.p.m., for a sufficient time to allow centrifugal separation of the anticoagulated whole blood in bag 8 into PRP and packed RBC's. This dwell period takes about one minute. The hydraulic timer 15 then unclamps the PRP tubing 16.

The pressure exerted by the pressure plate 50 on the whole blood bag 8 as the rotor continues to spin is sufficient to force the plasma separated in bag 8, which is of lower density, out the exit port of the bag and into PRP tubing 16, which is centrally located on the side of the whole blood bag nearest the center of rotation. The weight plate is needed here as initially the plasma must be pushed toward the center of rotation of the rotor as it leaves the blood bag.

Once fluid starts flowing from the whole blood bag 8 to the PRP bag 6 a siphon effect is created, inasmuch as the whole blood bag 8 is located at a shorter radius than the PRP bag and therefore at a higher potential energy.

Under these conditions, once the PRP tubing 16 is filled with fluid, the difference in potential energy from the whole blood bag 8 to the PRP bag 6 favors flow in that direction and pressure from the pressure plate 50 is no longer required to maintain flow. However, the plate still serves a useful function to prevent the buildup of excessive dynamic waves on the inner wall of the blood bag.

Once initiated, fluid flow will continue, therefore, means are required to automatically stop the flow of plasma before any RBC is lost. Various means may be employed, such as photodetectors sensitive to change in color (See FIG. 19 of copending application Ser. No. 281,649) or a Pheresis Valve (also described in patent application Ser. No. 281,649).

In the embodiment shown in FIG. 5 of the invention, automatic flow control is provided by a Pheresis Valve, the details of which are not necessary for an understanding of the present invention. Suffice it to say that the Pheresis Valve consists of a ball stopper located in the whole blood bag 8 so as to float on top of the packed RBC layer. The specific gravity of the ball stopper is greater than plasma but less than RBC. A separated first blood component, such as plasma layer, occupies the radially inner portion of the flexible blood-processing bag 8 whereas separated second blood component such as RBC layer occupies the radially outward portion. The pressure plate 50 applies a force in the radially outward direction which tends to collapse the flexible blood processing bag 8 and expel the first blood component (plasma layer) therefrom.

As the first blood component (plasma) is expressed from the flexible blood processing bag 8 by the force of pressure plate 50 moving radially outward the interface between the first and second components approaches the output port of the flexible whole blood bag 8; carrying with it the stopper ball. Eventually, the stopper ball is carried into contact and forms a seal with the port. Flow is thus halted automatically.

Plasma thus expressed into PRP bag 6 may be further separated into PRP and PPP withthe PPP being expressed into PPP bag 4, as described in detail in copending application Ser. No. 281,649.

Referring now to FIGS. 6 and 7, the details of the support structure 10 may be more readily described. FIG. 6 is a partial sectional view of a unsupported bag structure such as the structure described in the previously mentioned copending patent application, Ser. No. 281,649. As may be seen in FIG. 6 the outward acting pressure exerted as a reaction to the centrifugal force supplied by pressure plate 50 during rotation of the centrifuge is totally absorbed by the bag wall and weld. In particular, there are strong tensile forces directed upon the weld seam tending to cause separation of the weld.

FIG. *7a* shows the whole blood bag 8 as it is inserted into the support 10 of the present invention prior to the centrifugal force acting on plate 10. FIG. *7b* shows the structure under the influence of centrifugal force. The periphery of the support 10 abuts the edge welds of the bag 8. Plate 50 is pushed against support 10 which comes in contact with the inner face of bag 8 eventually creating approximately 60 pounds per square inch of opposing pressure within support 10 against bag 8. This pressure is at least substantially absorbed by the support 10 as contrasted to the unsupported structure of FIG. 6. Note that in the FIG. 7 embodiment, the support 10 causes the bag 8 to lie flat against the cassette wall.

In addition, the profile of bag 8 is changed by support 10 which minimizes tensile stress on the weld or seam of the bag. FIG. *8a* shows a force diagram of the seam area of an unsupported bag 8 of FIG. 6. The tensile force $F_t$ in the bag material can be divided into a horizontal force and vertical components $F_{th}$ and $F_{tv}$, respectively. Force $F_{tv}$ is opposed only by the tearing force $F_{weld}$. Force $F_{tv}$ is relatively large because of the basically circular cross-section of bag 8 in FIG. 6. Therefore, tearing force $F_{weld}$ is large, which is undesirable.

FIG. *8b* shows a force diagram of the seam area of a supported bag such as in FIG. *7b*. Here the tensile force $F_t$ is less than that in FIG. *8a* because the internal pressure of the bag is partially or mostly opposed by the pressure generated by the support 10. In addition, the vertical component of the tensile force $F_{tv}$ is less because of the wedge shape cross-section of bag 8 in FIG. *7b*. Therefore, the tearing force $F_{weld}$ is much less than in the prior design of FIG. *7a*.

EQUIVALENTS

Those skilled in the art may recognize other equivalents to the specific embodiments described herein, which equivalents are intended to be encompassed by the claims attached hereto. For example, the support 10 may be adapted to support either side of bag 8 or it may completely encircle the bag 8. Furthermore, while the bags shown in the preferred embodiments are of the type currently used in the blood processing industry consisting of seam welded structures, the invention may find applications to other bag structures as well. In particular, it is contemplated that blow molded seamless bags may predominate in the near future because of their potential lower cost. The use of the deformable support structure of the invention in conjunction with a seamless bag would allow manufacture of a thinner wall, less expensive, and more reliable bag than would be the case without such support.

I claim:

1. Apparatus for processing fluids in a centrifugal force field to separate constituent components of such fluids comprising in combination:

(a) a centrifuge having a rotor adapted to rotate at a sufficient speed to cause said components to separate;

(b) a flexible bag adapted to contain a first fluid to be separated into constituent components;

(c) a receiver container adapted to receive at least one component of said first fluid;

(d) mass means for initiating a flow of component of said first fluid from said flexible bag to said container, said mass means being disposed nearer the center of rotation of the rotor than the flexible bag and adapted to move against a surface of said bag,; and (e) deformable support means having a recess conforming to the desired shape of said flexible bag and at least partially enclosing a surface of said bag furthest removed from the surface against which the mass means moves.

2. The apparatus of claim 1 in which the deformable support is a cast polymeric material.

3. The apparatus of claim 1 wherein the deformable support is sufficiently flexible to allow the mass means to exert a flow initiating force as the centrifuge rotates and sufficiently strong enough to absorb substantial reactive forces in the bag to prevent rupture of the bag during rotation of the centrifuge rotor.

4. Apparatus for processing fluids in a centrifugal force field to separate constituent components of such fluids comprising in combination:

(a) a centrifuge having a rotor adapted to rotate at a sufficient speed to cause said components to separate;

(b) a flexible bag adapted to contain a first fluid to be separated into constituent components;

(c) a receiver container adapted to receive at least one component of said first fluid;

(d) mass means for initiating a flow of component of said first fluid from said flexible bag to said container, said mass means being disposed nearer the center of rotation of the rotor than the flexible bag and adapted to move against a surface of said bag,;

(e) deformable support means having a recess conforming to the desired shape of said flexible bag and at least partially enclosing a surface of said bag furthest removed from the surface against which the mass means moves; and (f) wherein the support means causes the cross-sectional shape of the bag at the area of the edges to assume a contour which minimizes tensile force to enhance the ability of the bag to withstand centrifugal forces without shearing.

5. The apparatus of claim 4 wherein the cross-section at the edges is wedge-shaped.

6. The apparatus of claim 4 wherein the vertical component of the tensile force is reduced at the edges by the shape of the recess.

7. The apparatus of claim 6 wherein deformable support is flexible enough to exert a flow initiating force as the centrifuge rotates and sufficiently strong enough to absorb substantial reactive forces.

* * * * *